United States Patent [19]

Bolle et al.

[11] Patent Number: 4,778,419

[45] Date of Patent: Oct. 18, 1988

[54] REVERSE THRUST PROPELLER

[75] Inventors: Robert Bolle, Brugge, Belgium; Donald A. Henrich, Lake Villa, Ill.

[73] Assignee: Outboard Marine Corporation, Waukegan, Ill.

[21] Appl. No.: 63,208

[22] Filed: Jun. 16, 1987

Related U.S. Application Data

[63] Continuation-in-part of Ser. No. 880,024, Jun. 30, 1986, abandoned, which is a continuation of Ser. No. 720,885, Apr. 8, 1985, abandoned.

[51] Int. Cl.[4] ..... B63H 5/12

[52] U.S. Cl. ..... 440/89; 416/93 A; 416/245 A; 440/49

[58] Field of Search ..... 440/47, 88, 89, 900; 416/93 A, 93 R, 93 M, 245 A

[56] References Cited

U.S. PATENT DOCUMENTS

| | | | |
|---|---|---|---|
| 2,213,609 | 9/1940 | Ronning | 115/17 |
| 3,279,415 | 10/1966 | Kiekhaefer | 115/17 |
| 3,356,151 | 12/1967 | Strang | 170/135.71 |
| 3,444,932 | 8/1967 | Wlezien | 170/160.54 |
| 3,467,051 | 9/1969 | Shimanckas | 115/34 |
| 3,587,510 | 6/1971 | Shimanckas | 115/35 |
| 3,748,061 | 7/1973 | Henrich | 416/93 |
| 3,754,837 | 8/1973 | Shimanckas | 416/93 |
| 3,865,509 | 2/1975 | Frazzell et al. | 416/93 |
| 4,276,036 | 6/1981 | Nishida et al. | 440/89 |
| 4,436,514 | 3/1984 | Takahashi et al. | 440/89 |
| 4,511,339 | 4/1985 | Kasschau | 440/89 |

FOREIGN PATENT DOCUMENTS 55-148691 11/1980 Japan .

*Primary Examiner*—Sherman D. Basinger
*Assistant Examiner*—Edwin L. Swinehart
*Attorney, Agent, or Firm*—Michael, Best & Friedrich

[57] ABSTRACT

A marine propulsion device including a propeller shaft, a lower unit rotatably supporting the propeller shaft and including a lower unit exhaust passageway, and a propeller adapted to be submerged in water and including an inner hub connected to the propeller shaft. The propeller also includes an outer hub connected to and spaced from the inner hub and defining a propeller exhaust passageway having an inlet in communication with the lower unit exhaust passageway, a plurality of blades extending from the outer hub rearwardly of the inlet, an opening for communicating the lower unit exhaust passageway with water outside of the outer hub, and a member located adjacent and rearward of the opening, and extending forwardly and radially outwardly with respect to the propeller shaft.

20 Claims, 2 Drawing Sheets

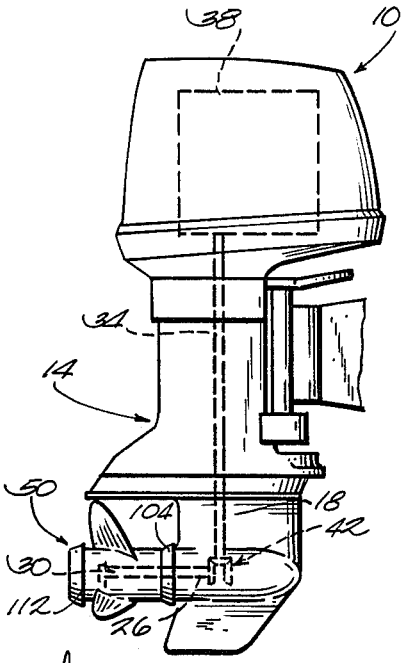
Fig. 1
Fig. 2
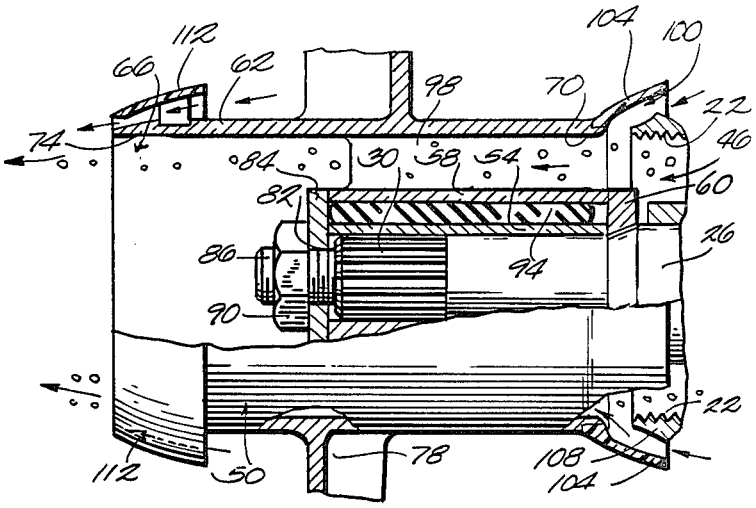
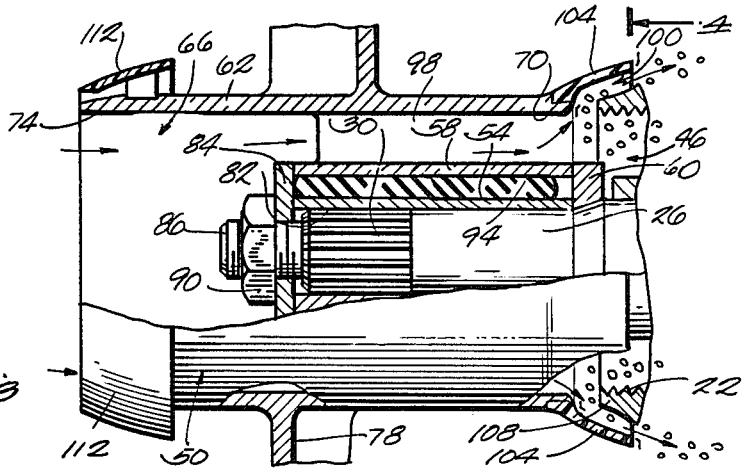
Fig. 3
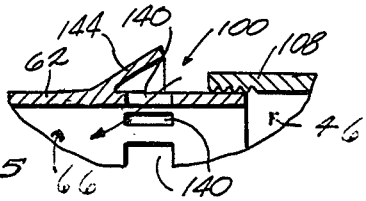
Fig. 5
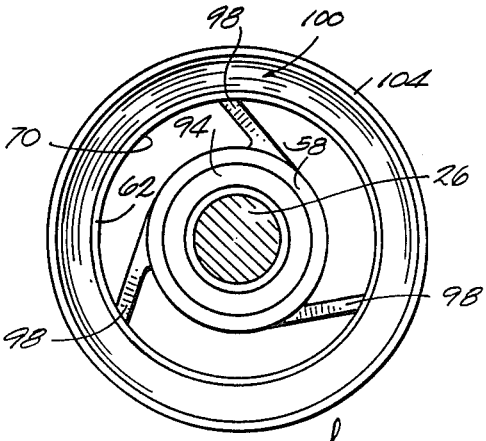
Fig. 4
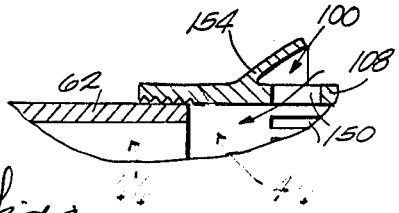
Fig. 6

REVERSE THRUST PROPELLER

RELATED APPLICATION

This is a continuation-in-part of copending application Ser. No. 880,024, filed June 30, 1986, now abandoned, which is a continuation of 720,885, filed Apr. 8, 1985, now abandoned.

BACKGROUND OF THE INVENTION

The invention related generally to marine propellers affording "through the hub" exhaust discharge. More particularly, the invention relates to marine propulsion devices including an arrangement for mounting a "through the hub" propeller on a propeller shaft.

Attention is directed to the following U.S. patents which illustrate marine propellers:

| Inventor | U.S. Pat. No. | Issued |
|---|---|---|
| Strang | 3,356,151 | December 5, 1967 |
| Shimanckas | 3,754,837 | August 28, 1973 |
| Nishida, et al. | 4,276,036 | June 30, 1981 |
| Takahashi, et al. | 4,436,514 | March 13, 1984 |
| Henick | 3,748,061 | July 24, 1973 |
| Shimanckas | 3,467,051 | September 16, 1969 |

SUMMARY OF THE INVENTION

The invention provides a marine propulsion device including a lower unit adapted to be submerged in water and comprising a propeller shaft, a gearcase which supports the propeller shaft for rotation about an axis and which includes a rearward end, and an outer surface which extends forwardly from the rearward end, the gearcase also including an internal exhaust passageway having, at the gearcase rearward end, an exhaust gas outlet with a given diameter, and a propeller including an inner hub connected to the propeller shaft, and an outer hub connected to and radially spaced from the inner hub and defining therebetween a propeller exhaust passageway having a discharge opening with a diameter substantially the same as the given diameter of the outlet, and an inlet located rearwardly of the lower unit exhaust passageway outlet and in communication therewith, the outer hub including a blade supporting portion, and a portion located forwardly of the blade supporting portion and extending, relative to the blade supporting portion, radially outwardly in spaced relation to the outer surface of the gearcase to define a forwardly facing annular opening located radially outwardly of the outer surface of the gearcase and for admitting water into the inlet of the propeller exhaust passageway during forward movement of the propulsion device, and a plurality of blades having radially inner ends connected to the blade supporting portion of the outer hub.

The invention also provides a propeller for a marine propulsion device including a lower unit having a gearcase rotatably supporting a propeller shaft and including a rearward end, and an outer surface which extends forwardly from the rearward end, the gearcase also including an internal exhaust passageway located around the propeller shaft and having, at the gearcase rearward end, an exhaust gas outlet having a diameter, the propeller including an inner hub adapted to be connected to the propeller shaft, and an outer hub connected to and radially spaced from the inner hub and defining therebetween a propeller exhaust passageway having a discharge opening with a diameter substantially the same as the given diameter of the outlet, and an inlet located rearwardly of the exhaust passageway outlet and in communication therewith, the outer hub including a blade supporting portion, and a portion located forwardly of the blade supporting portion and extending radially outwardly relative to the blade supporting portion so as to be located in radially outwardly and spaced relation to the outer surface of the gearcase to define a forwardly facing opening located radially outwardly of the outer surface of the gearcase and for admitting water into the inlet of the propeller exhaust passageway during forward movement of the propulsion device, and a plurality of blades having radially inner ends connected to the blade supporting portion of the outer hub.

The invention also provides a marine propulsion device including a lower unit adapted to be submerged in water and comprising a propeller shaft, a gearcase which supports the propeller shaft for rotation about an axis and which includes a rearward end, and an outer surface which extends forwardly from the rearward end, the gearcase also including an internal exhaust passageway having, at the gearcase rearward end, an exhaust gas outlet, and a propeller including an inner hub connected to the propeller shaft, and an outer hub connected to and radially spaced from the inner hub and defining therebetween a propeller exhaust passageway having an inlet located rearwardly of the lower unit exhaust passageway outlet and in communication therewith, the outer hub including a blade supporting portion, and a portion located forwardly of the blade supporting portion and extending, relative to the blade supporting portion, radially outwardly in spaced relation to the outer surface of the gearcase to define a forwardly facing annular opening located radially outwardly of the outer surface of the gearcase and for admitting water into the inlet of the propeller exhaust passageway during forward movement of the propulsion device, and a plurality of blades having radially inner ends connected to the blade supporting portion of the outer hub.

The invention also provides a propeller for a marine propulsion device including a lower unit having a gearcase rotatably supporting a propeller shaft and including a rearward end, and an outer surface which extends forwardly from the rearward end, the gearcase also including an internal exhaust passageway located around the propeller shaft and having, at the gearcase rearward end, an exhaust gas outlet, the propeller including an inner hub adapted to be connected to the propeller shaft, and an outer hub connected to and radially spaced from the inner hub and defining therebetween a propeller exhaust passageway having an inlet located rearwardly of the exhaust passageway outlet and in communication therewith, the outer hub including a blade supporting portion, and a portion located forwardly of the blade supporting portion and extending radially outwardly relative to the blade supporting portion so as to be located in radially outwardly and spaced relation to the outer surface of the gearcase to define a forwardly facing opening located radially outwardly of the outer surface of the gearcase and for admitting water into the inlet of the propeller exhaust passageway during forward movement of the propulsion device, and a plurality of blades having radially inner ends connected to the blade supporting portion of the outer hub.

The invention also provides a marine propulsion device comprising a propeller shaft, a gearcase rotatably supporting the propeller shaft and including a rearward end, an outer surface extending forwardly from the rearward end, and an internal exhaust passagewa having, at the gearcase rearward end, an exhaust gas outlet, and a propeller including an inner hub connected to the propeller shaft, an outer hub connected to and radially spaced from the inner hub to define therebetween a propeller exhaust passageway having a discharge opening with a given diameter, and an inlet opening located rearwardly of the gearcase exhaust gas outlet and in communication therewith, the inlet opening having a diameter greater than the given diameter of the discharge opening and extending radially outwardly relative to the outer surface of the gearcase so that water is admitted into the inlet opening of the propeller exhaust passageway during forward movement of the marine propulsion device, and a plurality of blades having radially inner ends connected to the outer hub.

The invention also provides a propeller for a marine propulsion device including a propeller shaft, a gearcase rotatably supporting the propeller shaft and including a rearward end, an outer surface extending forwardly from the rearward end, and an internal exhaust passageway having, at the gearcase rearward end, an exhaust gas outlet, the propeller comprising an inner hub adapted to be connected to the propeller shaft, an outer hub connected to and radially spaced from the inner hub to define therebetween a propeller exhaust passageway having a discharge opening with a given diameter, and an inlet opening adapted to be located rearwardly of the gearcase exhaust gas outlet and in communication therewith, the inlet opening having a diameter greater than the given diameter of the discharge opening and extending radially outwardly relative to the outer surface of the gearcase so that water is admitted into the inlet opening of the propeller exhaust passageway during forward movement of the marine propulsion device, and a plurality of blades having radially inner ends connected to the outer hub.

One of the principal features of the invention is the provision of a marine propeller which provides for propeller blade operation in essentially "solid" water in both a forward thrust direction and a reverse thrust direction by preventing exhaust gases from mixing with water around the propeller blades.

Another of the principal features of the invention is the provision of a marine propulsion device with a marine propeller which is simpler and less expensive to manufacture than some prior marine propellers and which provides for improved operation in both forward and reverse thrust directions.

Other features and advantages of the invention will become apparent upon reviewing the following description, the drawings and the appended claims.

BRIEF DESCRIPTION OF THE DRAWINGS

FIG. 1 is a schematic side representation of a marine propulsion device which embodies various of the features of the invention.

FIG. 2 is an enlarged side view, partially broken away, of the marine propeller and part of the lower unit of the marine propulsion device illustrated in FIG. 1. The propeller illustrated is shown providing forward thrust.

FIG. 3 is a view similar to FIG. 2 only illustrating the operation of the propeller when providing reverse thrust.

FIG. 4 is a cross-sectional view of the marine propeller and propeller shaft taken along the line 4—4 in FIG. 3.

FIG. 5 is a partial view similar to FIG. 2 of another embodiment of the invention.

FIG. 6 is a partial view similar to FIG. 2 of still another embodiment of the invention.

Figure 7:
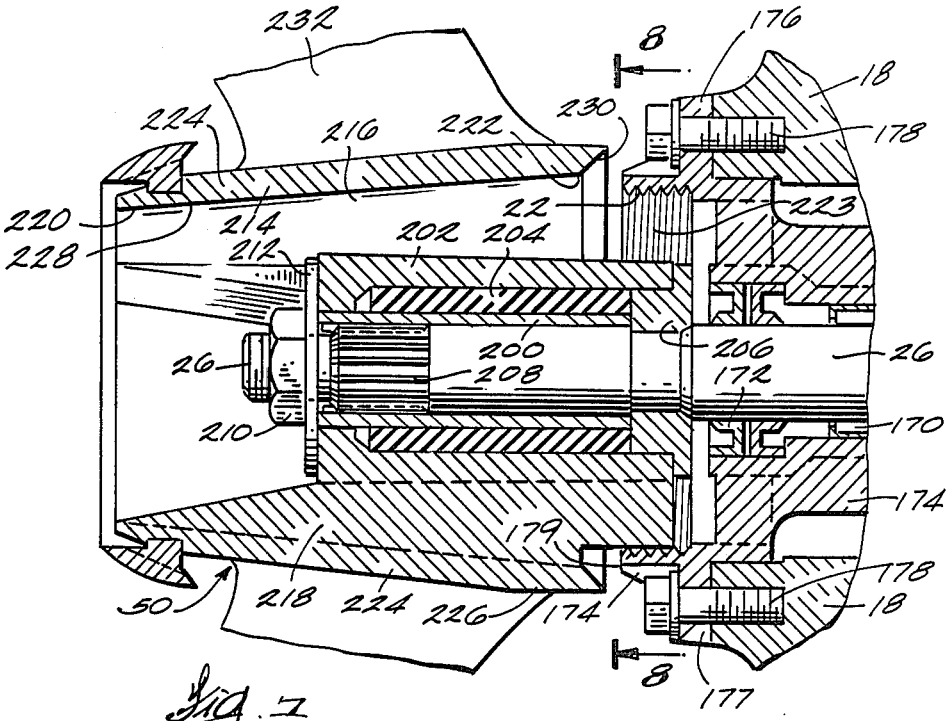
FIG. 7 is a view similar to FIG. 2 of a third embodiment of the invention.

Before one embodiment of the invention is explained in detail, it is to be understood that the invention is not limited in its application to the details of construction and the arrangement of components set forth in the following description or illustrated in the drawings. The invention is capable of other embodiments and of being practiced or carried out in various ways. It is also to be understood that the phraseology or terminology employed herein is for the purpose of description and no of limitation.

DESCRIPTION OF THE PREFERRED EMBODIMENT

Shown in the drawings is a marine propulsion device 10 in the form of an outboard motor. In other embodiments (not shown), the marine propulsion device 10 can be a stern drive unit.

As illustrated in FIG. 1, the marine propulsion device 10 includes a lower unit 14 which is vertically swingable and horizontally steerable. The lower unit 14 includes a portion or gearcase 18 which is normally submerged in water and which includes a rearwardly facing exhaust gas discharge opening or outlet 22 (see FIG. 2). Rotatably supported by the lower unit portion or gearcase 18 is a propeller shaft 26 which includes a rearward portion 30 extending through the lower unit exhaust gas discharge outlet 22 and rearwardly of the lower unit 14.

The marine propulsion device 10 also includes suitable means for rotatably driving the propeller shaft 26, which means includes a vertically extending drive shaft 34, an engine 38 operable to rotate the drive shaft 34, and a reversing transmission 42 connecting the drive shaft 34 to the propeller shaft 26. The lower unit 14 also includes an exhaust gas passageway 46 which communicates the lower unit exhaust outlet 22 with exhaust ports (not shown) of the engine 38.

Carried on the propeller shaft 26 for rotary movement in common therewith is a propeller 50 which rotates about an axis defined by the propeller shaft 26. The propeller 50 includes an inner sleeve 54 adapted to be connected to the propeller shaft 26, and an inner hub 58 concentric with and spaced from the inner sleeve 54. An annular thrust bearing 60 is located between the inner sleeve 54 and inner hub 58 and on a chamfer on the propeller shaft 26.

The propeller 50 also includes an outer hub 62 defining a propeller exhaust passageway 66 having an inlet 70 in communication with the lower unit exhaust passageway outlet 22, and an outlet 74 at the rearward end of the outer hub 62 which has (as shown in the drawings) a diameter substantially the same as the diameter of the exhaust passageway outlet 22 in the lower unit 14. The propeller 50 also includes a plurality of blades 78 extending from a blade supporting portion of the outer hub 62, which blade supporting portion is located rearwardly of the inlet 70.

More particularly, the propeller shaft rearward end is splined, and the inner sleeve 54 includes a splined recess 82 which receives the end of the propeller shaft 26. Means in the form of a rear washer 84, bolt 86 and a nut 90 arrangement is provided for attaching the inner sleeve 54 and inner hub 58 to the propeller shaft 26. A resilient bushing 94 is captured between the inner sleeve 54 and the inner hub 58 and acts as a slip clutch. The outer hub 62 is connected to the inner hub 58, as illustrated in FIGS. 2, 3 and 4, by a plurality of radially extending vanes 98.

While various constructions can be used in other embodiments, the marine propeller 50 also includes an opening 100 adjacent the lower unit exhaust outlet 22 for communicating the lower unit exhaust passageway 46 with water outside of the outer hub 62. More particularly, in the illustrated embodiment, the opening 100 is provided by spacing the outer hub 62 from the lower unit 14 so as to allow exhaust gases present at the lower unit exhaust outlet 22 to communicate with water outside of the outer hub 62.

The propeller 50 also includes a member 104 which is located adjacent and rearward of the opening 100, and which extends forwardly and radially outwardly with respect to the propeller shaft 26. More particularly, while other constructions can be employed in other embodiments, the member 104 is on, and can be considered a forward portion of, the outer hub 62 and extends curvilinearly forwardly and radially outwardly relative to the blade supporting portion and also with respect to the propeller shaft 26. Even more particularly, the member 104 is concave when viewed from the propeller shaft 26 forward of the member 104.

In the illustrated embodiment, the inner hub 58 and the outer hub 62 (except for the member or forward portion 104) are generally cylindrical. The member 104 is generally annular and at least partially defines the opening 100 communicating the lower unit exhaust passageway 46 with water outside of the outer hub 62. While other constructions can be employed in other embodiments, a portion 108 of the lower unit portion 18 is received radially inwardly of the member 104.

Although other constructions can be used in other embodiments, the member 104 is a plastic piece which is force fitted on the outer hub 62. In other embodiments (not shown), the member 104 can be a part of the outer hub 62 and can be cast as an integral piece of the outer hub 62.

If desired, a diverter ring 112 can be employed at the rear of the outer hub 62, as generally disclosed in Strang U.S. Pat. No. 3,356,151, which is incorporated hereby by reference.

In operation, the marine propeller 50 provides thrust in essentially "solid" water in both a forward thrust direction and a reverse thrust direction. In the forward thrust direction, as illustrated in FIG. 2, exhaust gases exiting the lower unit exhaust outlet 22 enter into the propeller exhaust inlet 70. The exhaust gases then pass through the propeller exhaust passageway 66 and exit out the propeller exhaust outlet 74. The diverter ring 112 helps prevent the exhaust gases exiting the propeller exhaust outlet 74 from mingling with water around the propeller blades 78. Further, the exhaust gases are generally prevented from exiting through the opening 100 between the outer hub 62 and the lower unit 14 by the member 104. The member 104 scoops water into the opening 100 as the propeller 50 moves through the water in the forward direction, and the water scooped by the member 104 prevents the exhaust gases from escaping through the opening 100, thereby keeping the gases in the propeller exhaust passageway 66 so the gases exit through the propeller exhaust outlet 74. As a result, the propeller blades 78 operate in essentially "solid" water in the forward thrust direction.

In operation in the reverse thrust direction, as illustrated in FIG. 3, gases from the lower unit exhaust outlet 22 exit through the opening 100 provided between the outer hub 62 and the lower unit 14. Water entering into the propeller exhaust passageway 66 through the propeller exhaust outlet 74 assists in forcing the exhaust gases out through the opening 100. The annular member 104 diverts away from the propeller blades 78 the exhaust gases passing through the opening 100 to prevent the exhaust gases from mixing with the water around the propeller blades 78. As a result, the propeller blades 78 operate in essentially "solid" water in the reverse thrust direction.

Alternate embodiments of the marine propulsion device are illustrated in FIGS. 5 and 6. The alternate embodiments are identical to the first embodiment except to the extent differences are indicated.

In the embodiment illustrated in FIG. 5, the opening 100 comprises a plurality of spaced openings 140 in communication with the propeller exhaust passageway 66 and located around the circumference of the outer hub 62 and forward of the propeller blades 78. The forward portion of the outer hub 62 is located radially inwardly and in contact with the lower unit portion 108. In this embodiment, an annular member 144 is on the outer hub 62 and is located adjacent and rearwardly of the plurality of openings 140.

In the embodiment illustrated in FIG. 6, the opening 100 comprises a plurality of spaced openings 150 in communication with the lower unit exhaust passageway 46 and located around the circumference of the lower unit generally cylindrical rearward portion 108 forming the lower unit exhaust outlet 22. In this embodiment, an annular member 154 is on the lower unit portion 108 and is located adjacent and rearward of the plurality of openings 150. In another embodiment (not shown), the plurality of openings 150 can be closer to the propeller outer hub 62 and the member 154 can be located on the propeller outer hub 62 adjacent and rearward of the plurality of openings 150.

Figure 8:
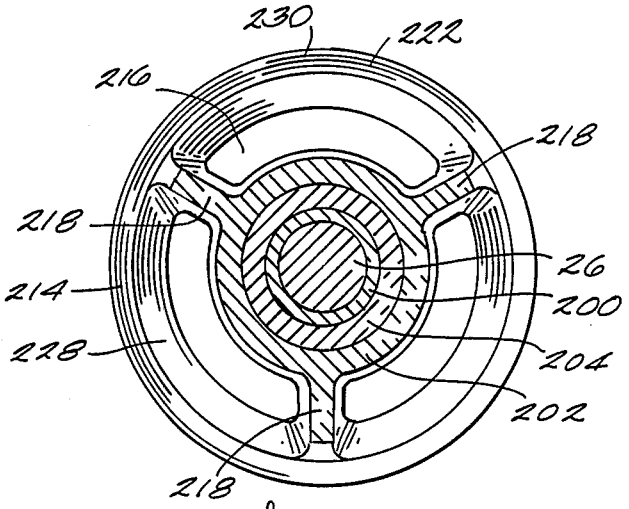
FIG. 8 is a view taken along line 8—8 in FIG. 7.

A third alternative embodiment of the invention is illustrated in FIGS. 7 and 8. The third alternative embodiment is similar to the first embodiment, and some common elements have been given the same reference numerals.

In the third alternative embodiment, the propeller shaft 26 is supported in the gearcase 18 by a bearing 170, and a seal 172 surrounds the propeller shaft 26 rearwardly of the bearing 170. In the illustrated construction, both the bearing 170 and the seal 172 are supported within the gearcase 18 by a retaining ring 174 which surrounds the propeller shaft 26, which is mounted on the rearward end of the gearcase 18, and which can be considered to be a portion of the gearcase 18. In fact, the retaining ring 174 defines the gearcase exhaust outlet 22. As shown in FIG. 7, the retaining ring 174 includes an upwardly extending lug 176 and a downwardly extending lug 177, both of which are secured to the remainder of the gearcase 18 by suitable means, such as bolts 178. The retaining ring 174 includes an annular portion 179 which extends rearwardly of the lugs 176 and 177 and which has an outer surface that is a rearward continuation of the outer surface of the remainder of the gearcase 18. It should be understood that other gearcase constructions, without the retaining ring 174, can be used in other alternative embodiments.

Also, in the third alternative embodiment, the propeller 50 includes an inner sleeve 200 connected to the propeller shaft 26, and an inner hub 202 concentric with and spaced from the inner sleeve 200. A resilient bushing 204 is captured between the inner hub 202 and the inner sleeve 200 and acts as a slip clutch. An annular thrust bearing 206 is located at the forward ends of the inner sleeve 200 and inner hub 202 and on a chamfer on the propeller shaft 26. As in the preferred embodiment, the propeller shaft 26 and the inner surface of the inner sleeve 200 are splined at 208, and the propeller 50 is secured to the propeller shaft 26 by a nut 210 threaded onto the rearward end of the propeller shaft 26. A washer 212 is captured between the nut 210 and the rearward ends of the inner sleeve 200 and inner hub 202.

The propeller 50 also includes an outer hub 214 connected to and radially spaced from the inner hub 202 to define therebetween a propeller exhaust passageway 216. In the illustrated construction, the outer hub 214 is connected to the inner hub 202 by a plurality of radially extending vanes 218. The propeller exhaust passageway 216 has a discharge opening 220 with a diameter substantially equal to the diameter of the gearcase exhaust gas outlet 22, and an inlet opening 222 located rearwardly of the gearcase exhaust gas outlet 22 and in communication therewith. In the illustrated construction, the forward end of the outer hub 214 has thereon a chamfer 230 which partially defines inlet opening 222 of the exhaust passageway 216, and which facilitates water flow into the inlet opening 222.

The inlet opening 222 has a diameter greater than the diameter of the discharge opening 220 and extends radially outwardly relative to the outer surface of the gearcase 18 so that water is admitted into the inlet opening 222 during forward movement of the outboard motor. More particularly, the inlet opening 222 extends radially outwardly relative to the outer surface of the retaining ring 174 and of the remainder of the gearcase 18 except at the top and bottom of the opening 222, at which points the gearcase 18, including the lugs 176 and 177 of the retaining ring 174, extends radially outwardly relative to the inlet opening 222. Therefore, a major portion of the inlet opening 222 is viewable from the front of the gearcase 18.

In the third alternative embodiment, the outlet 22 has therein internal threads 223, and each of the vanes 218 includes a portion which extends forwardly into the outlet 22 and closely adjacent the threads 223 so that anything, such as weeds or fishing line, that becomes wound around the propeller shaft 26 between the propeller 50 and the retaining ring 174 is cut by the threads 223.

In the illustrated construction, the outer hub 214 includes a rearwardly converging, frustoconical portion 224, and an integral, generally cylindrical portion 226 located forwardly of the frustoconical portion 224 and cooperating with the inner hub 202 to define the inlet opening 222. The outer hub 214 has a frustoconical or tapered inner surface 228 which is concentric with the outer surface of the frustoconical portion 224.

The propeller 50 also includes propeller blades 232 mounted on the outer hub 214.

Various of the features of the invention are set forth in the following claims.

We claim:

1. A marine propulsion device including a lower unit adapted to be submerged in water and comprising a propeller shaft, a gearcase which supports said propeller shaft for rotation about an axis and which includes a rearward end, and an outer surface which extends forwardly from said rearward end, said gearcase also including an internal exhaust passageway having, at said gearcase rearward end, an exhaust gas outlet with a given diameter, and a propeller including an inner hub connected to said propeller shaft, and an outer hub connected to and radially spaced from said inner hub and defining therebetween a propeller exhaust passageway having a discharge opening with a diameter substantially the same as said given diameter of said outlet, and an inlet located rearwardly of said lower unit exhaust passageway outlet and in communication therewith, said outer hub including a blade supporting portion, and a portion located forwardly of said blade supporting portion and extending, relative to said blade supporting portion, radially outwardly in spaced relation to said outer surface of said gearcase to define a forwardly facing annular opening located radially outwardly of said outer surface of said gearcase and for admitting water into said inlet of said propeller exhaust passageway during forward movement of said propulsion device, and a plurality of blades having radially inner ends connected to said blade supporting portion of said outer hub.

2. A marine propulsion device in accordance with claim 1 wherein said portion extends curvilinearly forwardly and radially outwardly with respect to said propeller shaft.

3. A marine propulsion device in accordance with claim 2 wherein said portion is concave when viewed from said propeller shaft.

4. A propeller for a marine propulsion device including a lower unit having a gearcase rotatably supporting a propeller shaft and including a rearward end, and an outer surface which extends forwardly from said rearward end, said gearcase also including an internal exhaust passageway located around the propeller shaft and having, at said gearcase rearward end, an exhaust gas outlet having a diameter, said propeller including an inner hub adapted to be connected to the propeller shaft, and an outer hub connected to and radially spaced from said inner hub and defining therebetween a propeller exhaust passageway having a discharge opening with a diameter substantially the same as said given diameter of said outlet, and an inlet located rearwardly of said exhaust passageway outlet and in communication therewith, said outer hub including a blade supporting portion, and a portion located forwardly of said blade supporting portion and extending radially outwardly relative to said blade supporting portion so as to be located in radially outwardly and spaced relation to the outer surface of the gearcase to define a forwardly facing opening located radially outwardly of the outer surface of the gearcase and for admitting water into said inlet of the propeller exhaust passageway during forward movement of said propulsion device, and a plurality of blades having radially inner ends connected to said blade supporting portion of said outer hub.

5. A marine propulsion device including a lower unit adapted to be submerged in water and comprising a propeller shaft, a gearcase which supports said propeller shaft for rotation about an axis and which includes a rearward end, and an outer surface which extends forwardly from said rearward end, said gearcase also including an internal exhaust passageway having, at said gearcase rearward end, an exhaust gas outlet, and a propeller including an inner hub connected to said propeller shaft, and an outer hub connected to and radially spaced from said inner hub and defining therebetween a propeller exhaust passageway having an inlet located rearwardly of said lower unit exhaust passageway outlet and in communication therewith, said outer hub including a blade supporting portion, and a portion located forwardly of said blade supporting portion and extending, relative to said blade supporting portion, radially outwardly in spaced relation to said outer surface of said gearcase to define a forwardly facing annular opening located radially outwardly of said outer surface of said gearcase and for admitting water into said inlet of said propeller exhaust passageway during forward movement of said propulsion device, and a plurality of blades having radially inner ends connected to said blade supporting portion of said outer hub.

6. A propeller for a marine propulsion device including a lower unit having a gearcase rotatably supporting a propeller shaft and including a rearward end, and an outer surface which extends forwardly from said rearward end, said gearcase also including an internal exhaust passageway located around the propeller shaft and having, at said gearcase rearward end, an exhaust gas outlet, said propeller including an inner hub adapted to be connected to the propeller shaft, and an outer hub connected to and radially spaced from said inner hub and defining therebetween a propeller exhaust passageway having an inlet located rearwardly of said exhaust passageway outlet and in communication therewith, said outer hub including a blade supporting portion, and a portion located forwardly of said blade supporting portion and extending radially outwardly relative to said blade supporting portion so as to be located in radially outwardly and spaced relation to the outer surface of the gearcase to define a forwardly facing opening located radially outwardly of the outer surface of the gearcase and for admitting water into said inlet of the propeller exhaust passageway during forward movement of said propulsion device, and a plurality of blades having radially inner ends connected to said blade supporting portion of said outer hub.

7. A marine propulsion device comprising a propeller shaft, a gearcase rotatably supporting said propeller shaft and including a rearward end, an outer surface extending forwardly from said rearward end, and an internal exhaust passageway having, at said gearcase rearward end, an exhaust gas outlet, and a propeller including an inner hub connected to said propeller shaft, an outer hub connected to and radially spaced from said inner hub to define therebetween a propeller exhaust passageway having a discharge opening with a given diameter, and an inlet opening located rearwardly of said gearcase exhaust gas outlet and in communication therewith, said inlet opening having a diameter greater than said given diameter of said discharge opening and extending radially outwardly relative to said outer surface of said gearcase so tht water is admitted into said inlet opening of said propeller exhaust passageway during forward movement of said marine propulsion device, said outer hub including a rearwardly converging, frustroconical portion, and a plurality of blades having radially inner ends extending from said frustroconical portion of said outer hub.

8. A marine propulsion device as set forth in claim 7 wherein said gearcase exhaust gas outlet has a diameter substantially equal to said given diameter of said discharge opening.

9. A marine propulsion device as set forth in claim 7 wherein said outer hub also includes a generally cylindrical portion located forwardly of said frustoconical portion and cooperating with said inner hub to define said inlet opening.

10. A marine propulsion device comprising a propeller shaft, a gearcase rotatably supporting said propeller shaft and including a rearward end, an outer surface extending forwardly from said rearward end, and an internal exhaust passageway having, at said gearcase rearward end, an exhaust gas outlet, and a propeller including an inner hub connected to said propeller shaft, an outer hub connected to and radially spaced from said inner hub to define therebetween a propeller exhaust passageway having a discharge opening with a given diameter, and an inlet opening located rearwardly of said gearcase exhaust gas outlet and in communication therewith, said inlet opening having a diameter greater than said given diameter of said discharge opening and extending radially outwardly relative to said outer surface of said gearcase so that water is admitted into said inlet opening of said propeller exhaust passageway during forward movement of said marine propulsion device, said outer hub including a rearwardly converging, frustroconical portion, and a portion located forwardly of said frustroconical portion, having a generally cylindrical outer surface, and cooperating with said inner hub to define said inlet opening, and a plurality of blades having radially inner ends extending from said frustroconical portion of said outer hub.

11. A marine propulsion device comprising a propeller shaft, a gearcase rotatably supporting said propeller shaft and including a rearward end, an outer surface extending forwardly from said rearward end, and an internal exhaust passageway having, at said gearcase rearward end, an exhaust gas outlet, and a propeller including an inner hub connected to said propeller shaft, an outer hub connected to and radially spaced from inner hub to define therebetween a propeller exhaust passageway having a discharge opening with a given diameter, and an inlet opening located rearwardly of said gearcase exhaust gas outlet and in communication therewith, said inlet opening having a diameter greater than said given diameter of said discharge opening and extending radially outwardly relative to said outer surface of said gearcase so that water is admitted into said inlet opening of said propeller exhaust passageway during forward movement of said marine propulsion device, said outer hub including a blade supporting portion, and a second portion located forwardly of said blade supporting portion, extending radially outwardly relative to said blade supporting portion, and cooperating with said inner hub to define said inlet opening, and a plurality of blades having radially inner ends connected to said blade supporting portion of said outer hub.

12. A marine propulsion device as set forth in claim 11 wherein said second portion extends curvilinearly forwardly and radially outwardly with respect to said propeller shaft.

13. A marine propulsion device as set forth in claim 12 wherein said second portion is concave when viewed from said propeller shaft.

14. A propeller for a marine propulsion device including a propeller shaft, a gearcase rotatably supporting the propeller shaft and including a rearward end, an outer surface extending forwardly from the rearward end, and an internal exhaust passageway having, at the gearcase rearward end, an exhaust gas outlet, said propeller comprising in inner hub adapted to the connected to the propeller shaft, an outer hub connected to and radially spaced from said inner hub to define therebetween a propeller exhaust passageway having a discharge opening with a given diameter, and an inlet opening adapted to be located rearwardly of the gearcase exhaust gas outlet and in communicating therewith, said inlet opening having a diameter greater than said given diameter of said discharge opening and extending radially outwardly relative to the outer surface of the gearcase so that water is admitted into said inlet opening of said propeller exhaust passageway during forward movement of the marine propulsion device, said outer hub including a rearwardly converging, frustroconical portion, and a plurality of blades having radially inner ends extending from said frustroconical portion of said outer hub.

15. A propeller as set forth in claim 14 wherein the gearcase exhaust gas outlet has a diameter substantially equal to said given diameter of said discharge opening.

16. A propeller as set forth in claim 14 wherein said outer hub also includes a generally cylindrical portion located forwardly of said frustoconical portion and cooperating with said inner hub to define said inlet opening.

17. A propeller for a marine propulsion device including a propeller shaft, a gearcase rotatably supporting the propeller shaft and including a rearward end, an outer surface extending forwardly fron the rearward end, and an internal exhaust passageway having, at the gearcase rearward end, an exhaust gas outlet, said propeller comprising in inner hub adapted to be connected to the propeller shaft, an outer hub connected to and radially spaced from said inner hub to define therebetween a propeller exhaust passageway having a discharge opening with a given diameter, and an inlet opening adapted to be located rearwardly of the gearcase exhaust gas outlet and in communicating therewith, said inlet opening having a diameter greater than said given diameter of said discharge opening and extending radially outwardly relative to the outer surface of the gearcase so that water is admitted into said inlet opening of said propeller exhaust passageway during forward movement of the marine propulsion device, said outer hub including a rearwardly converging, frustonconical portion, and a portion located forwardly of said frustroconical portion, having a generally cylindrical outer surface, and cooperating with said inner hub to defined said inlet opening, and a plurality of blades having radially inner ends extending from said frustroconical portion of said outer hub.

18. A propeller for a marine propulsion device including a propeller shaft, a gearcase rotatably supporting the propeller shaft and including a rearward end, an outer surface extending forwardly from the rearward end, and an internal exhaust passageway having, at the gearcase rearward end, an exhaust gas outlet, said propeller comprising an inner hub adapted to be connected to the propeller shaft, an outer hub connected to and radially spaced from said inner hub to define therebetween a propeller exhaust passageway having a discharge opening with a given diameter, and an inlet opening adapted to be located rearwardly of the gearcase exhaust gas outlet and in communication therewith, said inlet opening having a diameter greater than said given diameter of said discharge opening and extending radially outwardly relative to the outer surface of the gearcase so that water is admitted into said inlet opening of said propeller exhaust passageway during forward movement of the marine propulsion device said outer hub including a blade supporting portion, and a second portion located forwardly of said blade supporting portion, extending radially outwardly relative to said blade supporting portion, and cooperating with said inner hub to define said inlet opening, and a plurality of blades having radially inner ends connected to said blade supporting portion of said outer hub.

19. A propeller as set forth in claim 18 wherein said second portion extends curvilinearly forwardly and radially outwardly with respect to said propeller shaft.

20. A propeller device as set forth in claim 19 wherein said second portion is concave when viewed from said propeller shaft.

* * * * *